US009125794B2

(12) United States Patent
Walker et al.

(10) Patent No.: US 9,125,794 B2
(45) Date of Patent: Sep. 8, 2015

(54) WATER FEATURE FOR A SPA

(75) Inventors: Victor Lee Walker, Murrieta, CA (US); Timothy P. Pflueger, San Diego, CA (US)

(73) Assignee: New Dimension One Spas, Inc., Chino Hills, CA (US)

( * ) Notice: Subject to any disclaimer, the term of this patent is extended or adjusted under 35 U.S.C. 154(b) by 884 days.

(21) Appl. No.: 11/669,844

(22) Filed: Jan. 31, 2007

(65) Prior Publication Data

US 2007/0118984 A1 May 31, 2007

Related U.S. Application Data

(60) Division of application No. 10/702,198, filed on Nov. 4, 2003, now abandoned, which is a continuation-in-part of application No. 10/279,379, filed on Oct. 23, 2002, now Pat. No. 6,839,919.

(51) Int. Cl.

| | |
|---|---|
| ***A47K 3/00*** | (2006.01) |
| ***A61H 33/00*** | (2006.01) |
| ***A61H 33/02*** | (2006.01) |
| ***E04H 4/00*** | (2006.01) |

(52) U.S. Cl.

CPC ..... *A61H 33/0087* (2013.01); *A61H 33/02* (2013.01); *E04H 4/005* (2013.01); *E04H 4/0037* (2013.01); *A61H 33/601* (2013.01); *E04H 2004/0068* (2013.01)

(58) Field of Classification Search

USPC ..... 4/541.1, 541.3, 624, 661, 559, 496, 4/507; 119/253; 239/16–23; 362/96

See application file for complete search history.

(56) References Cited

U.S. PATENT DOCUMENTS

| | | | | |
|---|---|---|---|---|
| 172,605 | A | | 1/1876 | Burdette |
| D126,223 | S | | 4/1941 | Ille |
| 2,417,499 | A | | 3/1947 | Ille |
| 3,317,927 | A | | 5/1967 | Shields |
| 3,579,599 | A | | 5/1971 | Barker |
| D221,495 | S | | 8/1971 | Cavenah |
| 3,736,599 | A | | 6/1973 | Kessler et al. |
| 3,869,736 | A | | 3/1975 | Valois et al. |
| 3,913,332 | A | | 10/1975 | Forsman |
| 3,974,605 | A | | 8/1976 | Beatty et al. |
| 4,055,922 | A | | 11/1977 | Ellington et al. |
| 4,233,694 | A | * | 11/1980 | Janosko et al. ..... 4/541.3 |
| D280,342 | S | | 8/1985 | Kohler |
| D283,545 | S | | 4/1986 | Kohler |
| 4,637,873 | A | | 1/1987 | DeSousa et al. |
| 4,782,538 | A | | 11/1988 | Chisholm et al. |
| 4,828,626 | A | | 5/1989 | Meincke |
| 4,847,926 | A | | 7/1989 | Laputka |
| 5,054,135 | A | | 10/1991 | Dallaire et al. |
| 5,167,368 | A | * | 12/1992 | Nash ..... 239/17 |
| 5,186,351 | A | | 2/1993 | Gallo et al. |

(Continued)

*Primary Examiner* — Tuan N Nguyen
(74) *Attorney, Agent, or Firm* — The Webb Law Firm

(57) ABSTRACT

Among other things, a spa includes a spa shell and a water feature disposed on the spa shell. The water feature includes a ridge disposed in an interior area of the spa shell and having a top disposed near a water line of the spa shell. The water feature also includes a water inlet disposed adjacent to the ridge opposite a main body of water area in the interior area of the spa shell, the water inlet being placed lower than the top of the ridge. In addition, the water feature includes a slope descending from the top of the ridge in the direction of the water inlet, the slope having a patterned top surface configured to interact with water flowing over the ridge, down the slope and toward the water inlet.

19 Claims, 9 Drawing Sheets

(56) References Cited

U.S. PATENT DOCUMENTS

| | | | | | |
|---|---|---|---|---|---|
| 5,236,581 | A | | 8/1993 | Perry | |
| 5,325,644 | A | | 7/1994 | Cornelius | |
| 5,333,325 | A | | 8/1994 | Levien et al. | |
| 5,501,178 | A | * | 3/1996 | Kemp | 239/17 |
| 5,518,611 | A | * | 5/1996 | Bresolin | 210/167.27 |
| 5,571,409 | A | * | 11/1996 | Scarborough | 239/20 |
| 5,799,345 | A | | 9/1998 | Hansen et al. | |
| 6,094,877 | A | | 8/2000 | White | |
| D435,297 | S | | 12/2000 | Magray et al. | |
| 6,226,938 | B1 | | 5/2001 | Hodak | |
| 6,349,427 | B1 | * | 2/2002 | Bergstrom | 4/541.1 |
| 6,395,167 | B1 | | 5/2002 | Mattson et al. | |
| 6,405,386 | B1 | | 6/2002 | Chang | |
| 6,447,137 | B1 | * | 9/2002 | Long | 362/96 |
| 6,450,122 | B1 | * | 9/2002 | Frank | 239/17 |
| 6,460,483 | B1 | * | 10/2002 | Northrop et al. | 119/74 |
| 6,595,675 | B2 | * | 7/2003 | Dongo | 362/562 |
| 6,839,919 | B2 | | 1/2005 | Pugliese, Jr. et al. | |
| 6,883,722 | B2 | * | 4/2005 | Pankow | 239/17 |

* cited by examiner

WATER FEATURE FOR A SPA

CROSS REFERENCE TO RELATED APPLICATIONS

This application is a divisional application of and claims the benefit of the priority of U.S. application Ser. No. 10/702,198 filed Nov. 4, 2003 now abandoned which is a continuation-in-part and claims the benefit of the priority of U.S. application Ser. No. 10/279,379, filed Oct. 23, 2002, that issued on Nov. 11, 2005 as U.S. Pat. No. 6,839,919, both of which are hereby incorporated by reference.

BACKGROUND

Typical spas are designed around dimensional lumber and are usually very linear in shape. Some deviations do occur in certain models but only on one or two sides. Spas with very linear shell shapes require very linear frames that are easily constructed with dimensionally-squared lumber, like standard two-by-four or two-by-two lumber. As a consequence, traditional spas are very squared or rectangular. In a square or rectangular spa, rounded seating space is sacrificed as it is fit as best as possible into squared corners.

Typical linear spas are very plain looking, especially when the cover is on and they are not in use. Linear spas are not architecturally pleasing and are usually not a focal point for the customers' landscape architecture. Accordingly, many spa owners hide their spas with landscaping or put them inside structures such as gazebos.

The typical spa is designed with primarily with only hydrotherapy in mind. Some spa designs do provide an additional water feature, which usually entails a plumbing device to pump out water into the main body of water of the spa. These waterfalls are for mostly for visual effect, typically lit with lights or other optic features, and achieve a very artificial sound. Other spas also provide sound systems such as stereos, but these systems are also unnatural and can detract from the therapeutic aspects of the spa.

Another limitation in most spa designs is ingress and egress. Spas rarely have internal steps because they sacrifice too much seating area. Coupled with the awkward seat configurations found in most linear spas, ingress and egress for a user of a typical spa is difficult. Yet another limitation in typical spa designs is the placement and functionality of the filter bucket. Most filter buckets occupy a "dead area," i.e., an area of the spa that cannot be utilized for hydrotherapy or other uses. Because of their single function of continuously receiving large amounts of water for filtering and pumping, filter buckets are not conceived of as an aesthetic element of the overall spa design.

SUMMARY

A curvilinear spa shell provides for an aesthetically pleasing and functionally efficient spa form. In one embodiment, a curvilinear spa shell includes a top edge that defines four rounded concave corners and four convex side walls connecting two of the concave corners. Each of the rounded corners preferably have a radius that exceeds twelve inches. The top edge of the spa is substantially symmetrical about an axis through the center of opposing side walls, as well as through the center of opposing concave corners.

The curvilinear spa shell improves the seat placement efficiency, ingress and egress to and from the spa, and accommodates various therapeutic devices such as visual and audio therapy features. In one example, a water feature that may, but without limitation, be provided in the curvilinear spa and extending from one side wall into the interior of the spa for being a focal point for users of the spa.

One example water feature includes a ridge in an interior area of the spa and having a top disposed at, or just below or above a water line of the spa. The water feature also includes a water inlet adjacent to the ridge and opposite a main body of water area in the interior area. The water inlet is disposed in the spa at a depth lower than the top of the ridge. The water feature also includes a slope descending from the top of the ridge in the direction of the water inlet. The slope includes a patterned top surface configured to interact with water flowing over the ridge, down the slope and toward the water inlet, to produce a pleasing running water sound. The water feature may also include a light feature that illuminates water on or near the slope to enhance the therapeutic effects of the water feature.

The details of one or more embodiments are set forth in the accompanying drawings and the description below. Other features, objects, and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
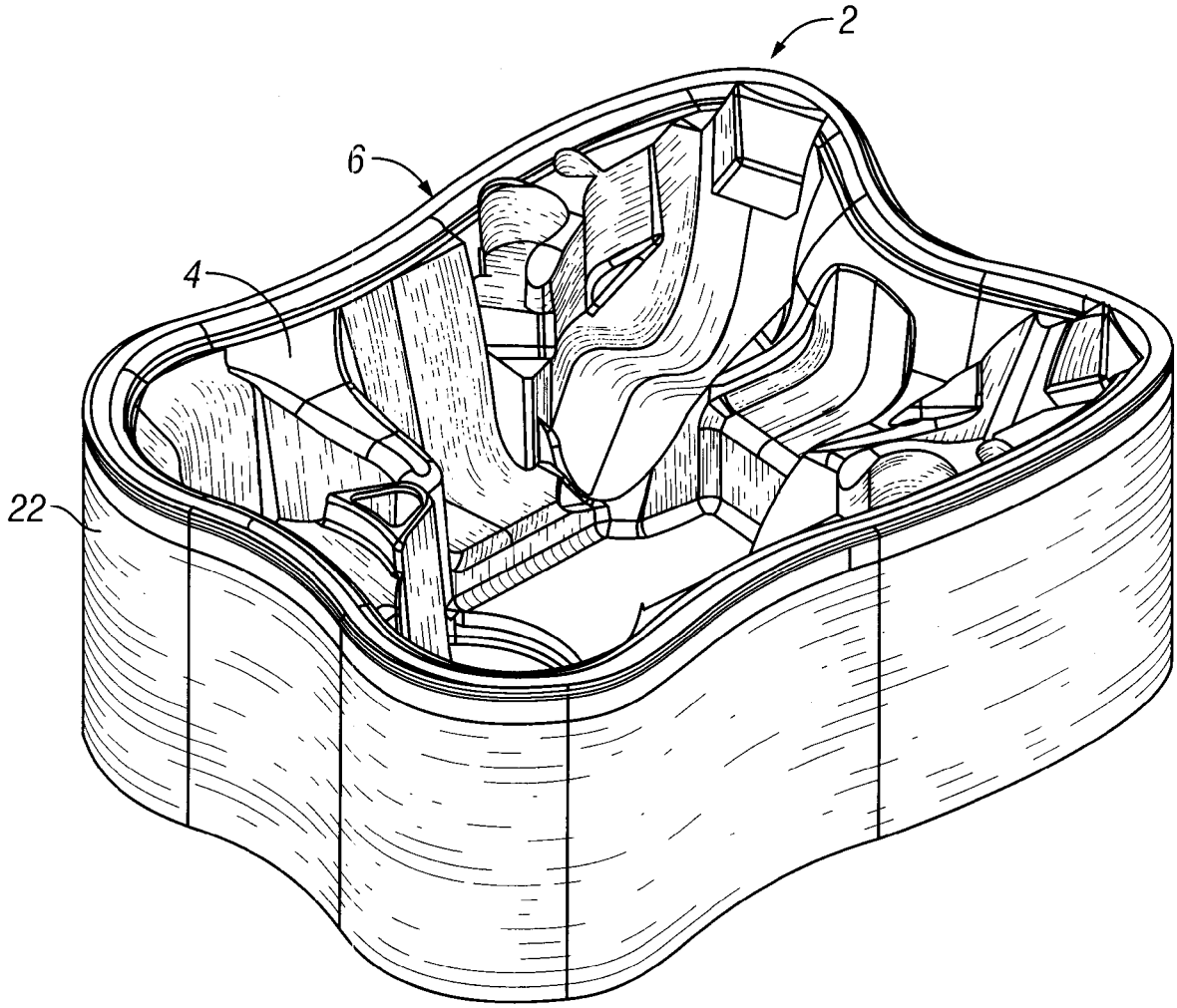
FIG. 1 is an isometric view of a curvilinear spa.

FIG. 1 depicts an embodiment of a curvilinear spa 2. Curvilinear spa 2 has an inner shell 4 that can hold water and includes support for spa users while experiencing the benefits of hydrotherapy. Bar top 6 substantially follows the contour of the curvilinear spa outline formed in part by the decorative siding 22.

Figure 2:
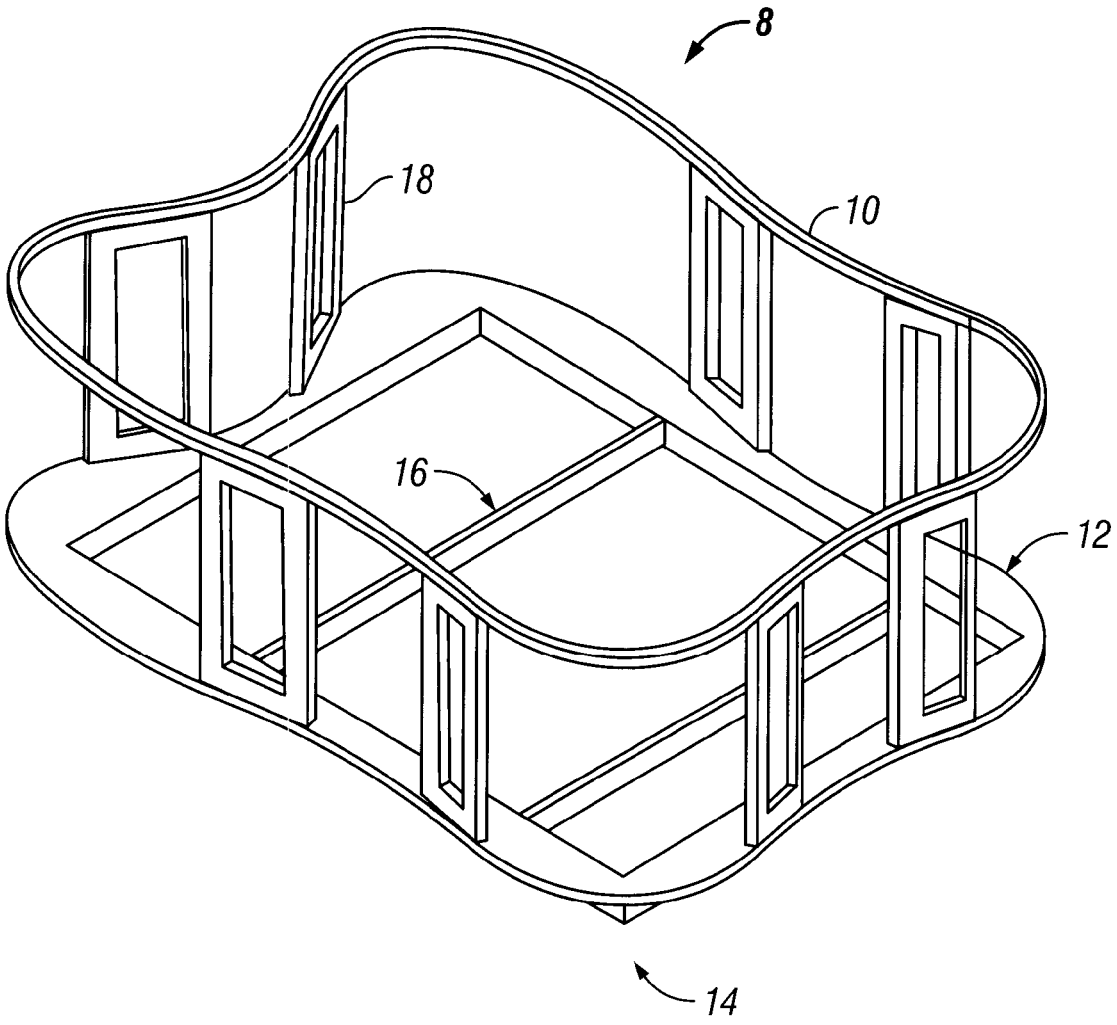
FIG. 2 is an isometric view of a curvilinear spa frame.

FIG. 2 depicts a curvilinear spa frame 8 that supports the curvilinear spa shell 4. As depicted in FIG. 2, the curvilinear spa frame 8 includes a top rail 10 and a bottom rail 12. The top rail 10 and bottom rail 12 substantially mimics the contour of the curvilinear spa 2. The top rail 10 and bottom rail 12 can be made of any material suitable for supporting the weight associated with the use of the shell 4, for example, wood, metal, composite materials like fiberglass, etc. The top rail 10 can be substantially the same shape as the bar top 6 and can support the weight associated with the bar top 6. During assembly, the top rail 10 can be aligned with and become an anchor for the bar top 6.

As depicted in FIG. 2, the bottom rail 12 can be supported by a bottom pedestal 14 or similar support structure. The bottom pedestal 14 is used to give additional stability to the frame and like the top and bottom rail, can be made of any material capable of supporting the weight of the spa, like wood, metal, composite materials like fiberglass, etc. For additional rigidity, bottom beam 16 can be secured to the opposing sides of the bottom pedestal 14. Other similar fastening techniques can be utilized as well to secure the bottom rail 12, top rail 10 and bottom pedestal 14 in a predetermined manner in order to facilitate assembly and rigidity.

As shown in FIG. 2, between top rail 10 and bottom rail 12 is a plurality of box sections 18. Box sections 18 provide rigidity to the frame structure in addition to providing support to the top rail 10. Box sections 18 are substantially linear and can be spaced intermittently substantially within the confines of the outer diameter of the curvilinear frame 8 thereby alleviating the need for more complex shaped support structures that follow the complex contours of the curvilinear spa frame 8. Box sections 18 can be prefabricated and made of any material capable of supporting the weight associated with the spa 2, like metal, wood, composite materials like fiberglass, etc.

Figure 3:
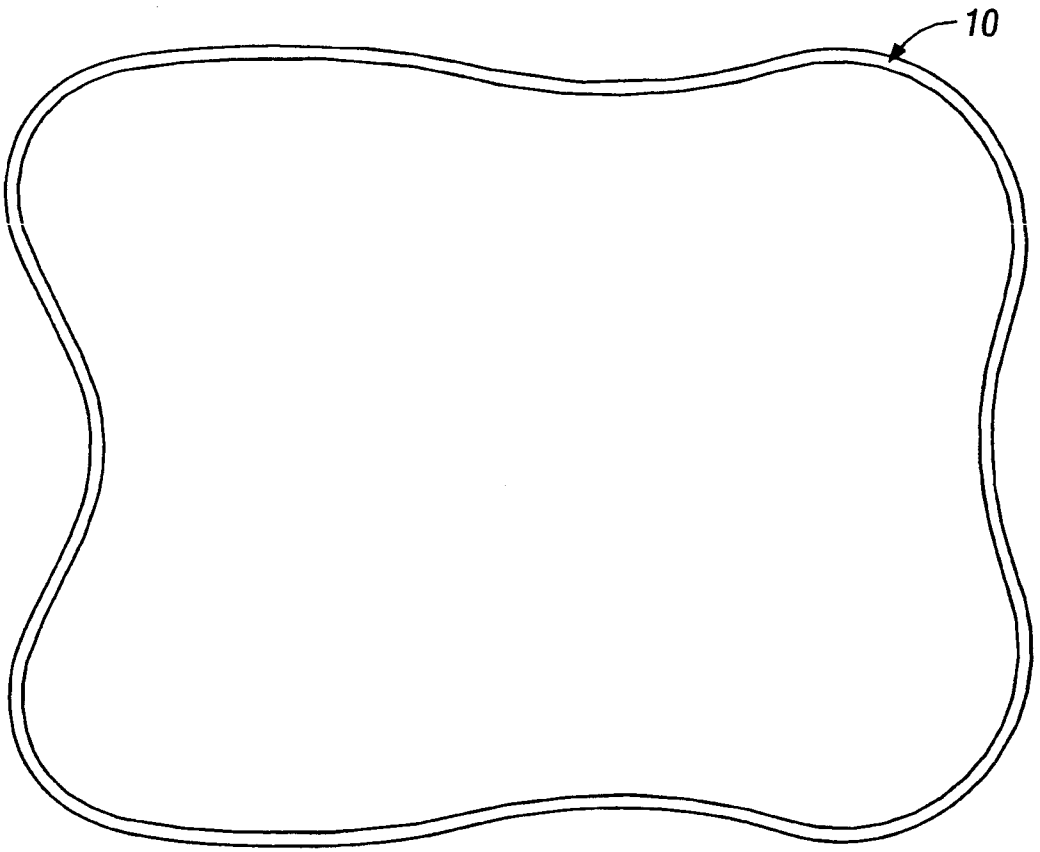
FIG. 3 is a top view of the top rail of the spa frame.

FIG. 3 depicts a top view of the top rail 10. Top rail 10 can be formed as one piece, or alternately, can be formed from a multiplicity of pieces, e.g., fabricated using a CNC machine. When the pieces are fastened, the top rail 10 is formed and becomes a structurally sound support member for the bar top 6 (not shown). If a multiplicity of overlapping pieces are utilized to fabricate top rail 10, glue, staples, or other known fasteners can be used to create an integrated top rail 10 member.

Figure 4A:
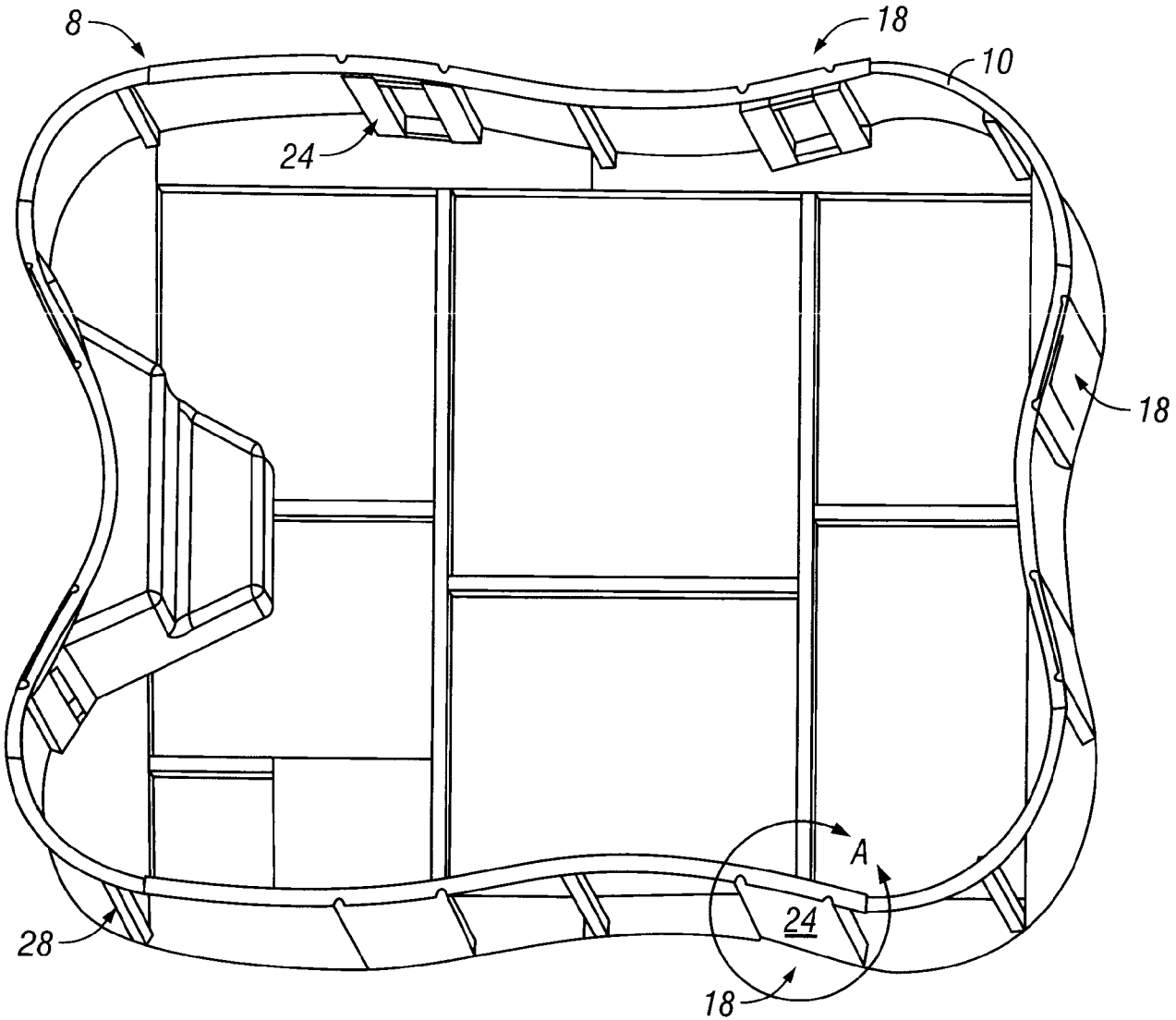
FIG. 4A is an isometric view of another embodiment of the curvilinear spa
Figure 4B:
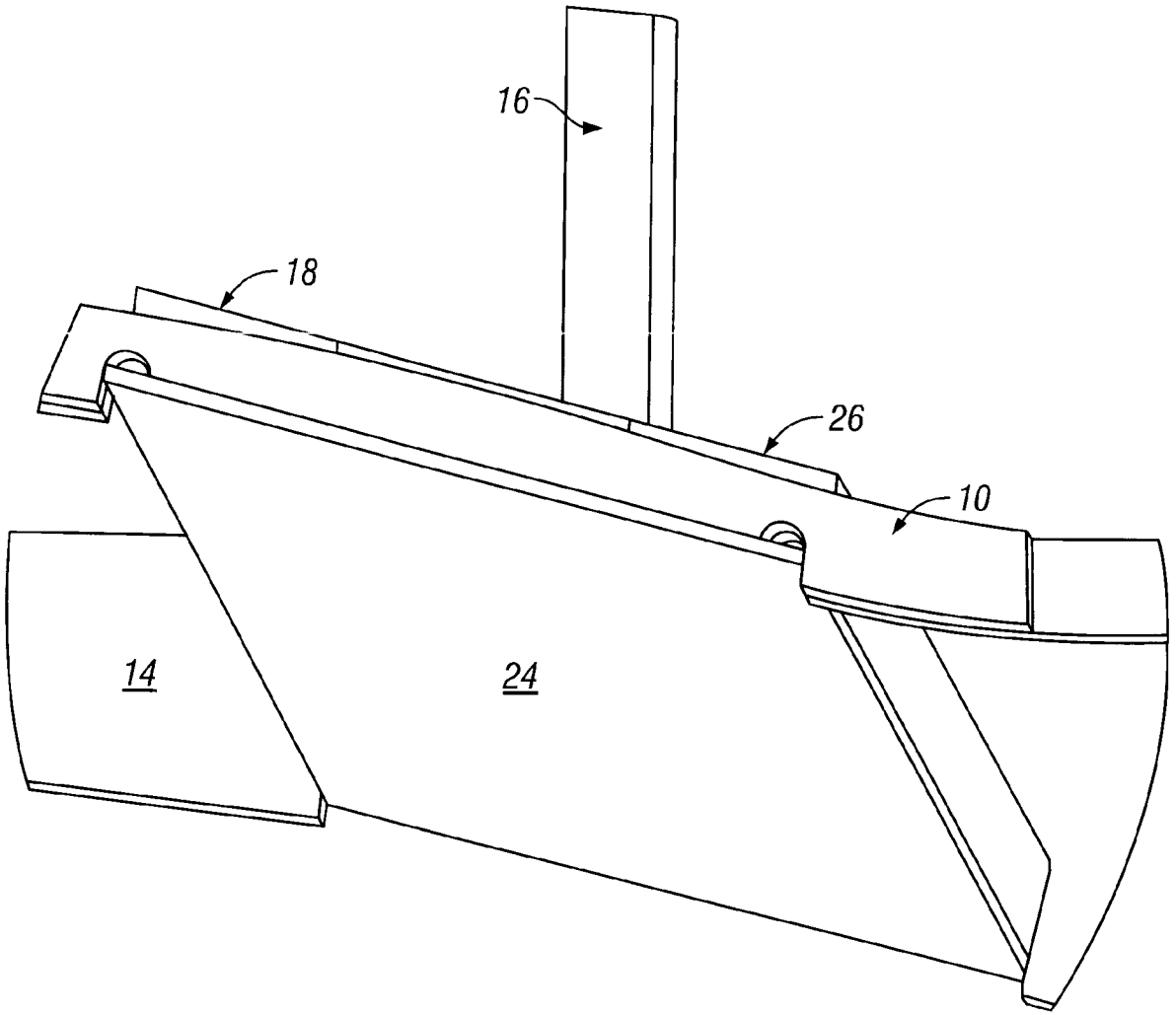
FIG. 4B is an isometric view of a box section with panel and interlocking groove.

FIGS. 4A and B depicts another embodiment of the curvilinear spa frame 8 that is easy to assemble and sufficiently rigid. As seen in FIG. 4A, the box sections 18 include a sheet 24 fastened in any known fashion to a rectangular structural member 26. As depicted in FIG. 4B, use of the sheet 24 not only improves rigidity, but also assists with alignment of curvilinear spa frame components, e.g., the top rail 10 and bottom rail 12. As depicted in FIG. 4B, the sheet 24 interlocks into notches in the top rail 10 and bottom rail 12. As a result, box section 18 can be readily inserted into the appropriate position between top rail 10 and bottom rail 12 thereby facilitating alignment of the top rail 10 and bottom rail 12. The notches can be located in various combinations of the top rail 10 and bottom rail 12, as long as the box section 18 assists alignment of the spa frame curvilinear components, e.g., the top rail 10 to the curvilinear bottom rail 12. Other fastening techniques can be utilized, e.g., predetermined placement of holes in the top and bottom rails with associated pegs on the top and bottom of the box section 12 (not shown). Additionally, strategic use of any modern fasteners, e.g., predetermined placement of pieces of sheet metal also may be used to ensure that corresponding box sections 18 are secured at corresponding predetermined locations in the curvilinear spa frame during assembly, thereby facilitating alignment of the curvilinear spa frame components. Those of skill in the art will appreciate the fact that many different types of interlocking construction can be utilized, e.g., pegs and holes, interlocking sheet material and notches, etc. The interlocking construction can be located on any and/or all curvilinear frame components to improve rigidity and increase ease of assembly. As depicted in FIG. 4A, additional supports 28, in this case 2×2s, can be included in the curvilinear spa frame 8 as needed to increase rigidity.

Figure 5:
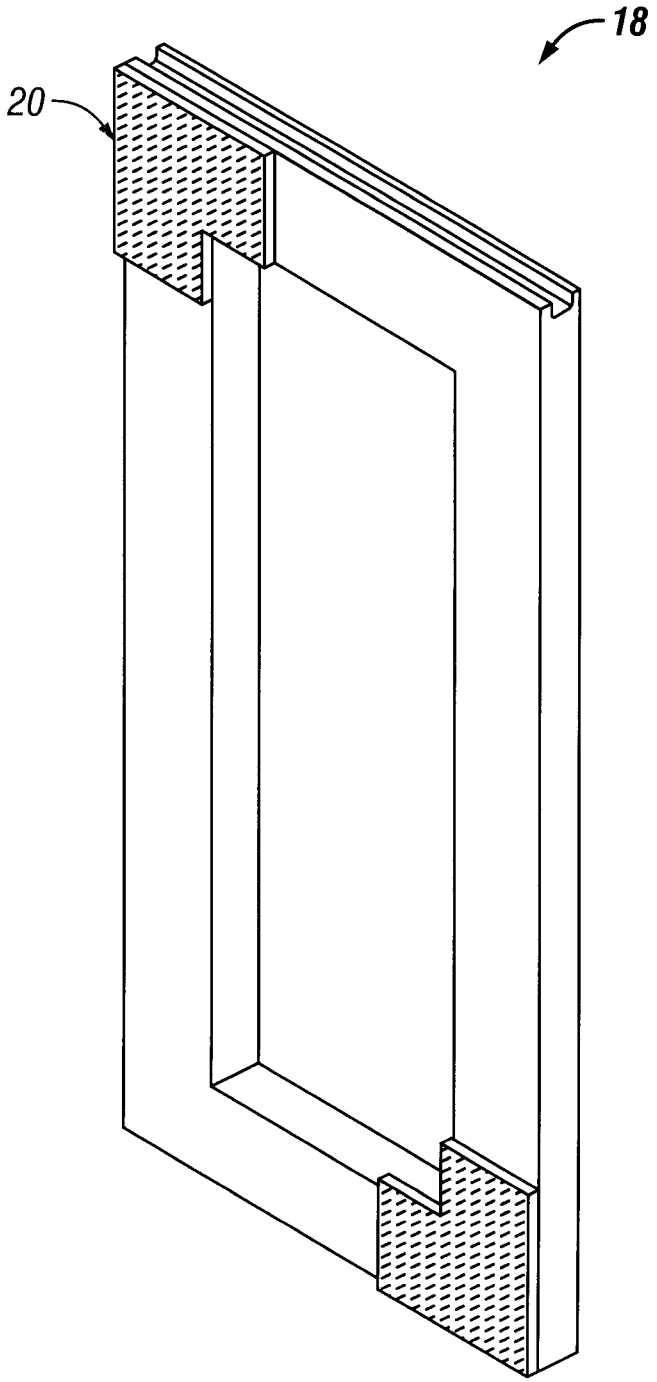
FIG. 5 is a box section with truss.

To further increase structural rigidity, FIG. 5 depicts the use of truss plates 20 on box section 18. If more rigidity is desired, additional truss plates 20 can be added. Typically, truss plates are made of sheets of galvanized steel and are secured into the box sections using pressure during fabrication. Moreover, increasing the strength of the box sections 18 may advantageously reduce the number of box sections 18 required to maintain the rigidity associated with the spa 2. To further reduce the number of box sections 18 required, additional supports 28 as depicted in FIG. 4A can be added.

Figure 6:
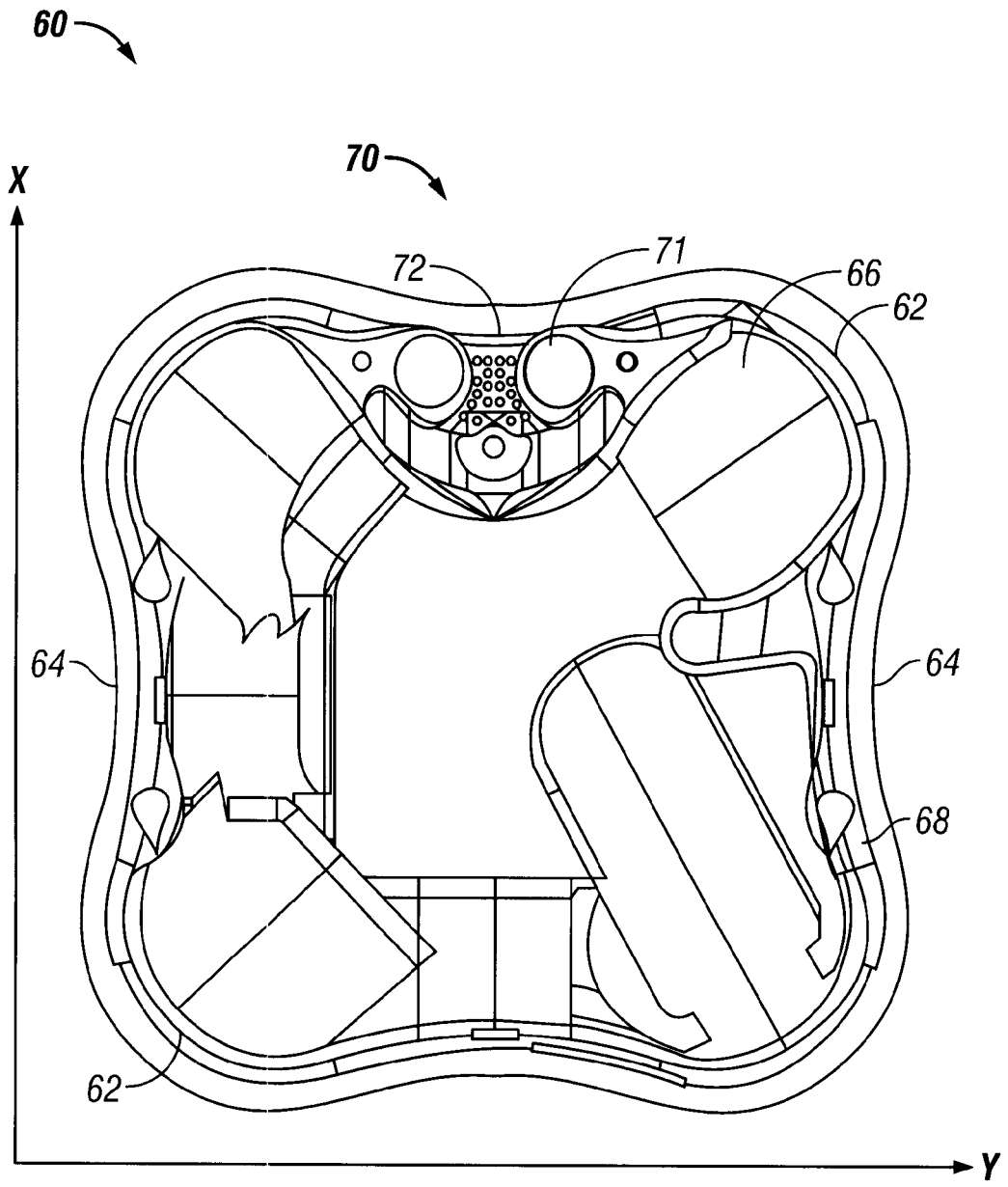
FIG. 6 is a top view of a curvilinear spa shell.

FIG. 6 is a two-dimensional, top-down view of a curvilinear spa shell 60. The spa shell 60 can be substantially the same size as a conventional square linear spa. The general contours of the spa shell 60 are defined by a top edge 68 that includes four substantially identical rounded corners 62 that are concave relative to an interior of the spa shell 60. The four corners 62 are connected to seamlessly form four side walls 64 that are convex relative to the interior of the shell 60. The contour of the spa shell 60 is symmetrical about both the x and y axes (i.e. through the middle of opposing side walls 64), as well as symmetrical along an axis through the middle of opposing corners 62.

The rounded corners 62 are formed with large interior radii, each radius preferably exceeding twelve inches, which produces a more efficient and effective seat design. Each rounded corner 62 can include a large seat 66 that can have many different configurations for accommodating various therapeutic devices and/or various sizes of users. Further, the location and orientation of each seat 66 within its respective corner 62 promotes multi-user alignment for increased social interaction, yet maximizes the space between the seats.

The seat arrangement also provides easier ingress and egress from a Spa constructed with the spa shell 60. For instance, the side walls 64 between the corners 62 provide a large area for a user to enter or exit the spa, and one or more of the side walls 64 may include one or more internal steps or ridges. Alternatively, one or more side walls 64 may include a small seat (not shown). Such a small seat can be positioned in the spa shell 60 such that it is more shallow than the large seats 66, thereby acting as a step to assist ingress and egress.

The top edge 68 defines the overall shape and form of the curvilinear design. The top edge 68 defines the four concave rounded corners 62 as well as the four convex side walls 64, and can receive a similarly-shaped spa cover (not shown) that continues the clover-leaf shape. The spa shell 60 below the top edge 68 can accommodate a number of contoured seats 66, and other spa features such as therapy jets, heater outlets, filter inlets, user controls, etc. The spa shell 60 can be made of a unitary layer of resilient material, such as thermoformed plastic or fiberglass. Thus, the spa shell 60 below the top edge 68 can have an outer surface that maintains the overall general curvilinear contours defined by the top edge 68, as well as an inner surface that fits within the general contour but provides the various spa features.

A filter section 70 having one or more water inlets 71 extends from one side wall 64 between two corners 62 and out toward the center of the spa shell 60. The water inlets 71 lead from the spa's main body for holding water to the spa's plumbing and/or filtering system. Thus, a filter (not shown) can be placed in front of a water inlet 71 from the perspective of the interior of the spa. The filter section 70 is disposed so as to be a focal point within the interior of the spa shell 60. The location and orientation of the filter section 70 in the spa shell 60 allows the filter section 70 to host, for optimal placement and use, one or more water features 72, such as a fountain or a "babbling brook" as described below. The filter section 70 may also host a light or array of lights, user controls, or a stereo control or other audio system.

This particular curvilinear design of the spa shell 60 can use a number of the same shell components in different areas because of its symmetry, and thus simplifies the manufacturing and component inventory control processes. Further, the design provides an agreeable aesthetic that is not provided by conventional spa designs. Thus, a spa that utilizes the curvilinear spa shell 60 will be an architectural and aesthetically-pleasing feature in addition to being therapeutically beneficial.

Figure 7:
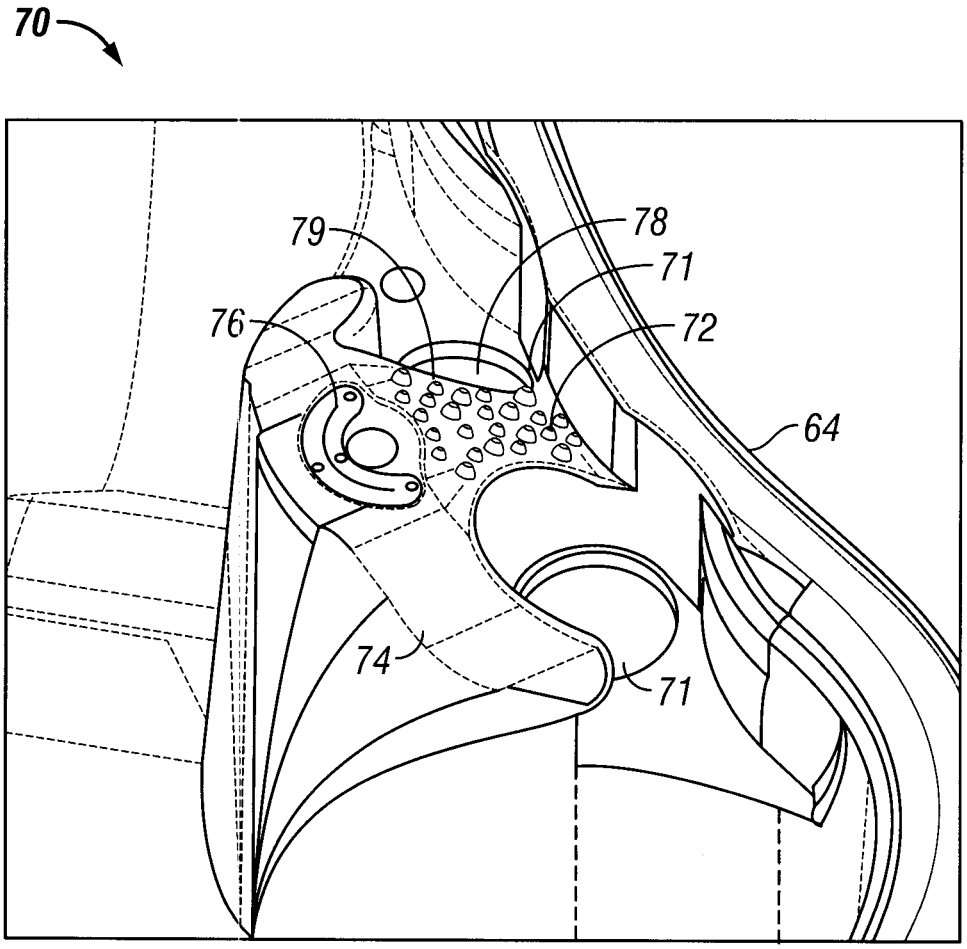
FIG. 7 is a perspective view of a portion of a spa shell to illustrate a filter section.

FIG. 7 is a perspective view of a portion of a spa shell 60 showing a filter section 70 that also includes a water feature 72. The filter section 70 includes one or more water inlets 71, i.e. an inlet to a filter or a pump, etc. The water inlets 71 are disposed along a side wall 64 of the spa shell and separated from the spa interior by a ridge 74. The ridge 74 may be linear or curved, and may be at or below or above a water line defined for the spa shell 60. The ridge 74 may extend at least part way around the water inlets 71. The water feature 72 is disposed adjacent to the one or more water inlets 71. In one example, the water feature 72 includes a slope 78 descending from the ridge 74 to the side wall 64 at which the slope 78 is lower than the top of the ridge 74. The slope 78 may include grooves and/or a number of protrusions 79, such as a number of various sizes of bumps. In the example, one water inlet 71 is positioned on either side of the slope 78 between the ridge 74 and the side wall 64.

In operation, water is either drawn in to the water inlets 71, or provided by an outlet (not shown) on the ridge 74, causing the water to travel over the ridge 74 and down the slope 78, and interact with the protrusions 79 and/or grooves to create a natural "babbling brook" sound. The length and angle of the slope 78 can be adjustable or varied in order to produce different sounds. The water flow rate may also be varied by, among other techniques, adjusting the flow rate into the water inlets 71, adjusting the height of the ridge 74, and/or adjusting the number and size of the protrusions 79 or grooves within the slope 78. The water feature 72 can also include a light feature 76 such as an array of LEDs or the like. The light feature 76 illuminates an area around the water flowing over the ridge 74 and down the slope 78 for a pleasing visual effect.

Figure 8:
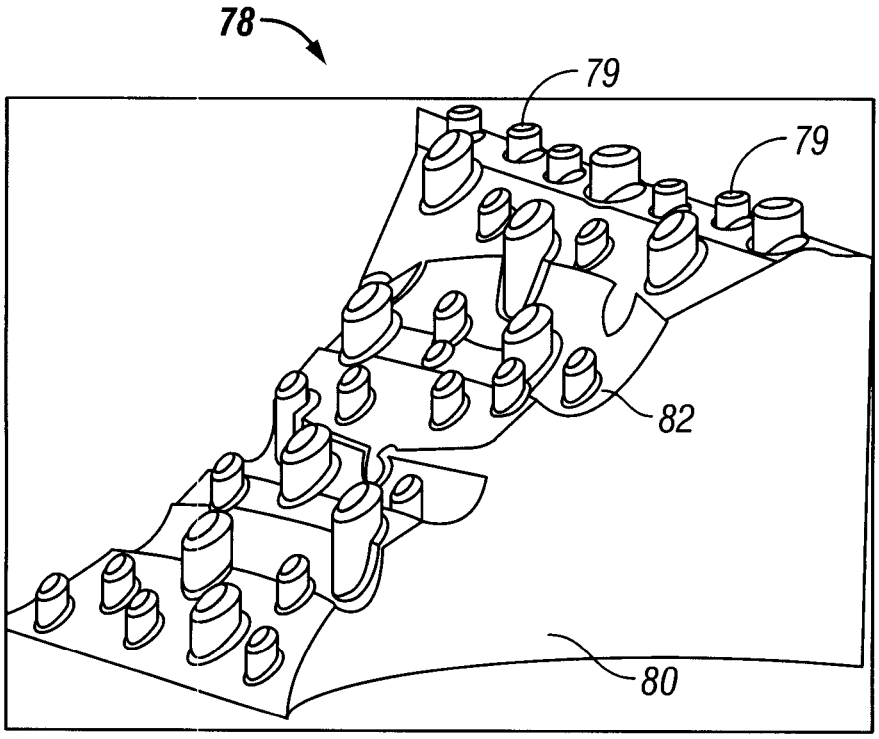
FIG. 8 is a perspective view of a water feature.

FIG. 8 shows a perspective of a slope 78 having a patterned top surface 80 in the form of a number of raised bumps 79 and curved grooves 82. The bumps 79 can be any size or geometry, such as squared, rounded, or angular. The grooves 82 can be any size, depth, length, or shape. The patterned top surface 80 of the slope 78 therefore can have a random "natural" look, or have a more ordered arranged look, depending on aesthetic preference. The feature 72 can create a calming sound of running water as it interacts with the patterned top surface 80 of the slope 78. The light feature 76 can create a pleasurable visual effect that can be experienced by a user whether or not the user is actually looking directly at the light feature 76.

Although a few embodiments have been described in detail above, other modifications are possible. Other embodiments may be within the scope of the following claims.

The invention claimed is:

1. A spa, comprising:

a spa shell; and a water feature disposed on the spa shell, the water feature further including:

a ridge disposed in an interior area of the spa shell and having a top disposed near a water line of the spa shell;

a water inlet disposed adjacent to the ridge and opposite a main body of water area in the interior area of the spa shell, the water inlet being placed lower than the top of the ridge; and a slope descending from the top of the ridge in the direction of the water inlet, the slope having a patterned top surface configured to interact with water flowing over the ridge, down the slope and toward the water inlet, and wherein the ridge separates the main body of water from an area defined by the water inlet.

2. The spa in accordance with claim 1, wherein the water inlet is a first water inlet and further comprising a second water inlet, the first and second water inlets disposed on opposite sides of the slope.

3. The spa in accordance with claim 1, wherein the water inlet is disposed adjacent to a side wall of the spa shell, and wherein the slope descends to the side wall at a position lower than the top of the ridge.

4. The spa in accordance with claim 1, wherein the ridge is disposed at a water line of the main body of water thereby allowing water to flow over the ridge from the main body of water.

5. The spa in accordance with claim 1, wherein the slope includes one or more circular protrusions, wherein the protrusions interact with the water flowing down the slope to provide an audibly pleasing sound.

6. The spa in accordance with claim 1, wherein the slope includes one or more elongated grooves, the grooves aligned substantially perpendicular to a downward angle of the slope.

7. The spa in accordance with claim 1, wherein an angle of the slope is adjustable.

8. The spa in accordance with claim 5, wherein at least one of the one or more protrusions is angled.

9. The spa in accordance with claim 1, further comprising a light feature disposed at or near the top of the ridge, and configured to provide light to the water flowing over the ridge and/or down the slope.

10. The spa in accordance with claim 9, wherein the light feature includes a plurality of light emitting diodes (LEDs).

11. The spa in accordance with claim 9, the light feature comprising a plurality of colors.

12. A method of providing an audibly pleasing sound in a spa, the method comprising:

providing a spa shell;

disposing a ridge at an interior area of the spa shell;

providing water to the ridge;

flowing water over a top of the ridge and;

down a slope descending from the top of the ridge to a level below the top of the ridge, the slope having a patterned top surface configured to interact with water; and interacting water with the patterned top surface to produce an audibly pleasing sound to a spa user.

13. The method of providing an audibly pleasing sound in a spa of claim 12, further comprising:

providing a plurality of protrusions of varying size to the patterned top surface; and aligning a plurality of grooves substantially perpendicular to the flowing water on the patterned top surface to facilitate the audibly pleasing sound to a spa user.

14. The method of providing an audibly pleasing sound in a spa of claim 12, further comprising illuminating water in different colors with a light emitting diodes thereby providing a pleasing visual effect in addition to the audibly pleasing sound to the spa user.

15. A spa comprising:

a spa shell defining a main spa area and defining a spa wall;

a ridge disposed at an interior area of the spa with respect to the spa wall and integrated to the spa shell; and a slope descending from the ridge to the interior area of the spa, the slope further including a patterned surface configured to interact with water flowing over the ridge and down the slope producing an audibly pleasing sound to a spa user.

16. The spa of claim 15, the slope further comprising:

a plurality of protrusions, the protrusions having varying sizes; and a plurality of grooves aligned substantially horizontal in relation to the ridge, the protrusions and groves together interacting with water flowing over the ridge and down the slope.

17. The spa of claim 15, the water feature further comprising:

a first water inlet; and a second water inlet, wherein the slope further comprises first and second opposing sides, wherein water flowing over first and second opposing sides flows individually toward the first and second water inlets.

18. The spa of claim 15, wherein the ridge is curved, and at least partially curves around the first water inlet.

19. The spa of claim 15 further comprising a water filter located downstream of the first water inlet.

* * * * *

UNITED STATES PATENT AND TRADEMARK OFFICE

CERTIFICATE OF CORRECTION

PATENT NO. : 9,125,794 B2
APPLICATION NO. : 11/669844
DATED : September 8, 2015
INVENTOR(S) : Walker et al.

It is certified that error appears in the above-identified patent and that said Letters Patent is hereby corrected as shown below:

In the claims

Column 6, Line 38, Claim 12, delete "and;" and insert -- and --

Signed and Sealed this
First Day of March, 2016

Michelle K. Lee

Michelle K. Lee
*Director of the United States Patent and Trademark Office*